US006955568B1

(12) United States Patent
Wu

(10) Patent No.: US 6,955,568 B1
(45) Date of Patent: Oct. 18, 2005

(54) MINIATURE CABLE CONNECTOR WITH CONTACT HOLDER

(75) Inventor: Jerry Wu, Irvine, CA (US)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/031,051

(22) Filed: Jan. 6, 2005

(51) Int. Cl.[7] ..... H01R 24/00
(52) U.S. Cl. ..... 439/660; 439/607; 439/701
(58) Field of Search ..... 439/660, 701, 439/607, 604, 695, 686

(56) References Cited

U.S. PATENT DOCUMENTS 6,106,338 A * 8/2000 Wu et al. ..... 439/660
6,139,372 A * 10/2000 Yang ..... 439/701
6,231,393 B1 5/2001 Lai
6,354,886 B1 * 3/2002 Yu ..... 439/701
6,398,587 B1 6/2002 Chen et al.
6,402,563 B1 6/2002 Shi et al.
6,623,299 B1 * 9/2003 Liu ..... 439/604
6,659,804 B2 * 12/2003 Nishio et al. ..... 439/660
2003/0203680 A1 * 10/2003 Boutros et al. ..... 439/660

* cited by examiner

*Primary Examiner*—Hien Vu
(74) *Attorney, Agent, or Firm*—Wei Te Chung

(57) ABSTRACT

A cable connector (100) includes an insulative housing (10), a number of contacts (20*a*–20*h*), a contact holder (30), a cable (50), and an overmold (60). Each contact comprises a contacting portion (21) received in the insulative housing and a tail portion (22) rearwardly extending beyond the housing. The contact holder is mounted to the insulative housing and latchably engaged with the housing. The contact holder defines a plurality of passageways (321), each tail portion of the contacts pass through a corresponding passageway. The cable has a plurality of conductors (54) soldered to corresponding tail portions of the contacts. The overmold encloses the insulative housing, the shell and the contact holder.

14 Claims, 15 Drawing Sheets

MINIATURE CABLE CONNECTOR WITH CONTACT HOLDER

BACKGROUND OF THE INVENTION

1. Field of the Invention

The present invention generally relates to an electrical cable connector, and more particularly to a miniature electrical cable connector used in connecting peripheral electronic devices with personal computers.

2. Description of Prior Art

FIG. 14 and FIG. 15 show a conventional miniature cable connector comprising an insulative housing 80, a plurality of terminals 90 mounted to the housing 80, a metal shell 70 enclosing the housing 80, a pair of cables connected to the terminals 90 and a cover (not shown) overmolded on the housing 80. The terminals 90 are inserted into the housing 80 from a rear face 801 of the housing 80 through a plurality of passageways 802, respectively. Each terminal 90 has a contacting portion 901 to be connected with a complementary connector, a retaining portion 902 received in a corresponding passageway 802 of the housing 80, and a tail portion 903 resisted by the rear face 801 of the housing 80 to be exposed beyond the housing 80. Thus, a forward movement of the terminals 90 relative to the housing 80 is prevented. However, a hot issue for this kind of connector is that a rearward movement trend of the terminals 90 relative to the housing 80 is inevitable to occur in assembly, especially when soldering conductors of the cable with the tail portions 903 of the terminals 90.

Hence, it is desirable to have an improved structure of the miniature cable connector to overcome the above-mentioned disadvantages of the prior art.

BRIEF SUMMARY OF THE INVENTION

Accordingly, it is an object of the present invention to provide a miniature cable connector which has a contact holder for preventing the contacts from moving rearwardly when soldering a cable thereto.

In order to achieve the above-mentioned object, a cable connector comprises an insulative housing, a plurality of contacts, a contact holder and a cable. Each contact comprises a contacting portion received in the insulative housing and a tail portion rearwardly extending beyond the housing. The contact holder is mounted to the insulative housing and latchably engaged with the housing, the contact holder defines a plurality of passageways, each tail portion of the contacts pass through a corresponding passageway. The cable having a plurality of conductors soldered to corresponding tail portions of the contacts.

Other objects, advantages and novel features of the invention will become more apparent from the following detailed description of the present embodiment when taken in conjunction with the accompanying drawings.

DETAILED DESCRIPTION OF THE INVENTION

Figure 1:
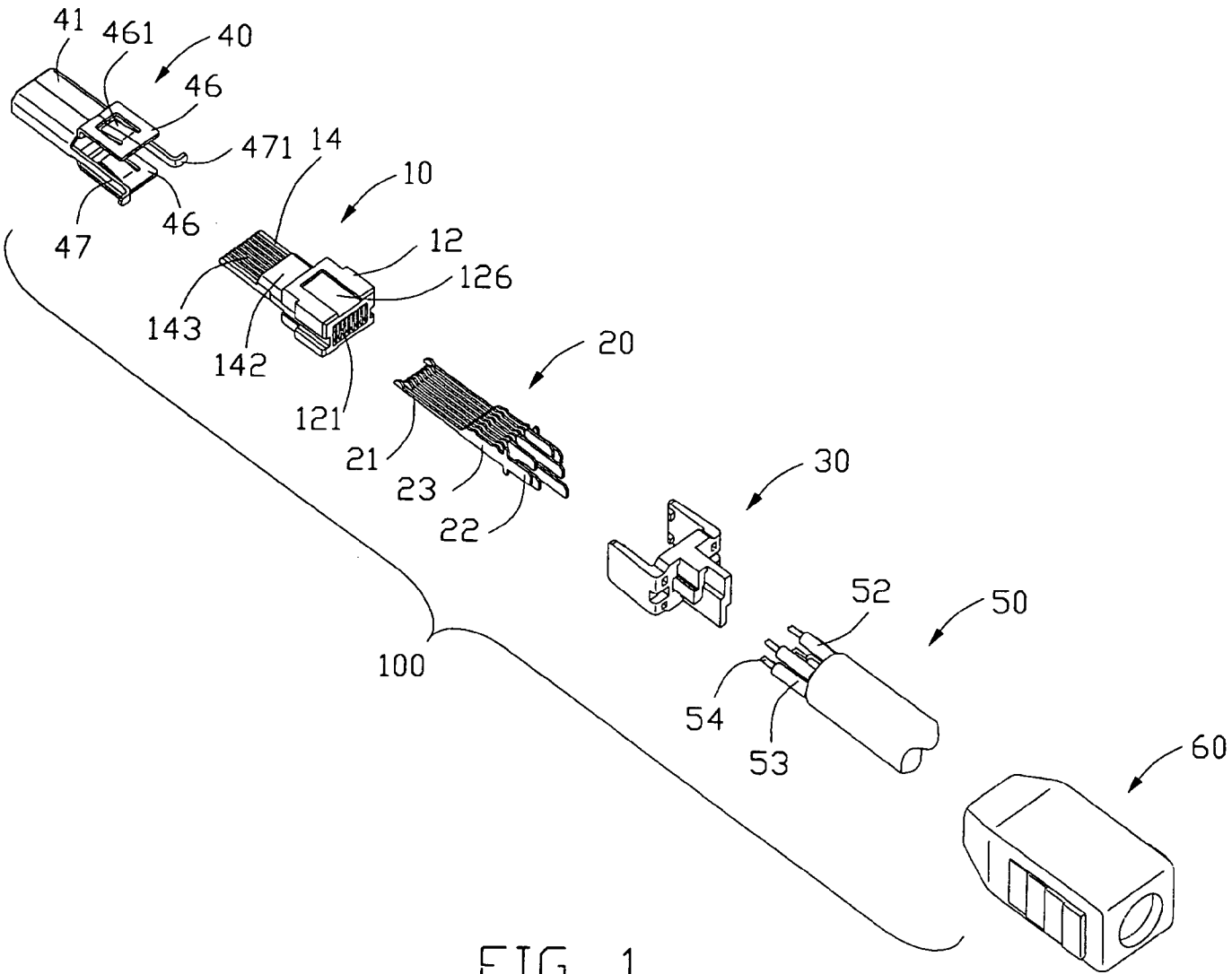
FIG. 1 is an exploded, perspective view of a cable connector in accordance with the present invention.

Reference will now be made to the drawing figures to describe the present invention in detail.

Figure 2:
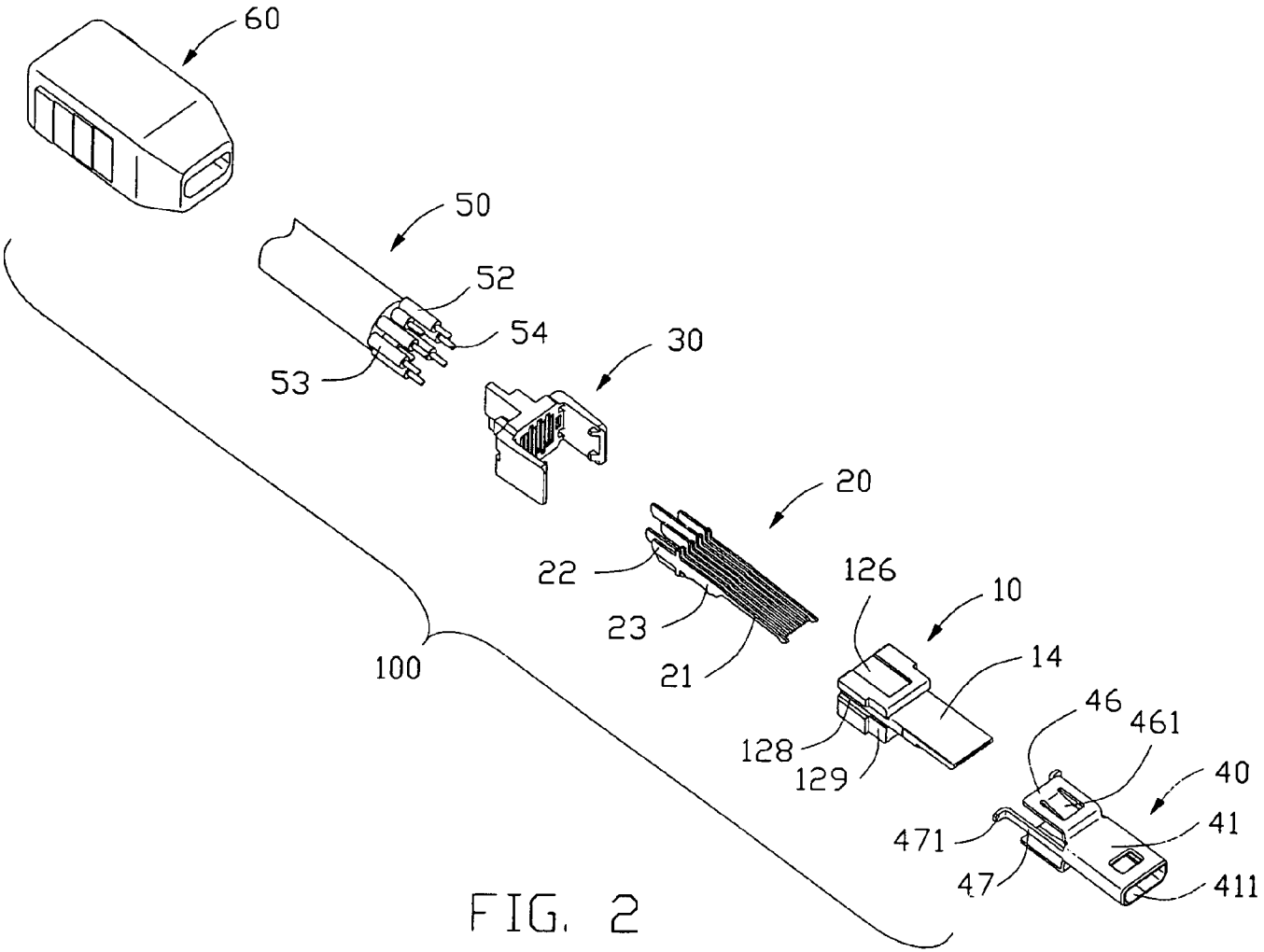
FIG. 2 is a view similar to FIG. 1, but from a different aspect.

Referring to FIGS. 1–2, a cable connector 100 in accordance with the present invention comprises an insulative housing 10, a contact set 20 received in the insulative housing 10, a contact holder 30 mounted to the housing 10 and the contact set 20, a metal shell 40 assembled to the insulative housing 10, a cable 50 and an overmold 60.

Figure 3:
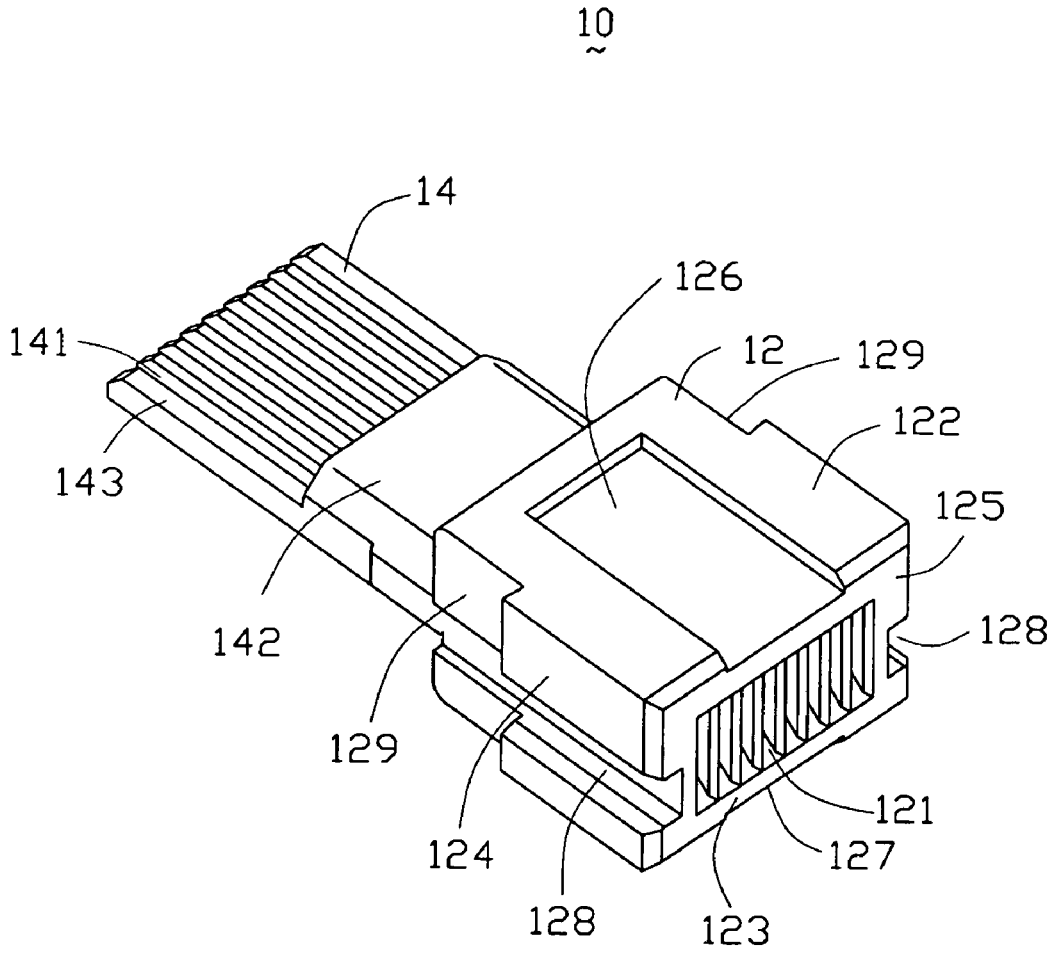
FIG. 3 is a perspective view of an insulative housing of the cable connector shown in FIG. 1.

Joining with FIG. 3, the insulative housing 10 comprises a base portion 12 and a tongue 14 extending forwardly from a center of the base portion 12 in a lengthwise direction. The base portion 12 defines a plurality of first passageways 121 extending therethrough, and comprises a top wall 122, a bottom wall 123 spaced arranged in a vertical direction and a pair of side walls 124, 125 spaced arranged in a lateral direction. The first passageways 121 are arranged in a row along the lateral direction. The top wall 122 and the bottom wall 123 each define a depression 126, 127 in a middle portion thereof. Each side wall 124, 125 define a slot 128 extending from a font face to a rear face of the base portion 12 and a recess 129 adjacent to the front face of the base portion 12. The tongue 14 comprises a mating portion 143 and a retaining portion 142 next to the mating portion 143. A plurality of contact channels 141 are defined along the tongue 14 and communicate with corresponding first passageways 121.

Figure 4:
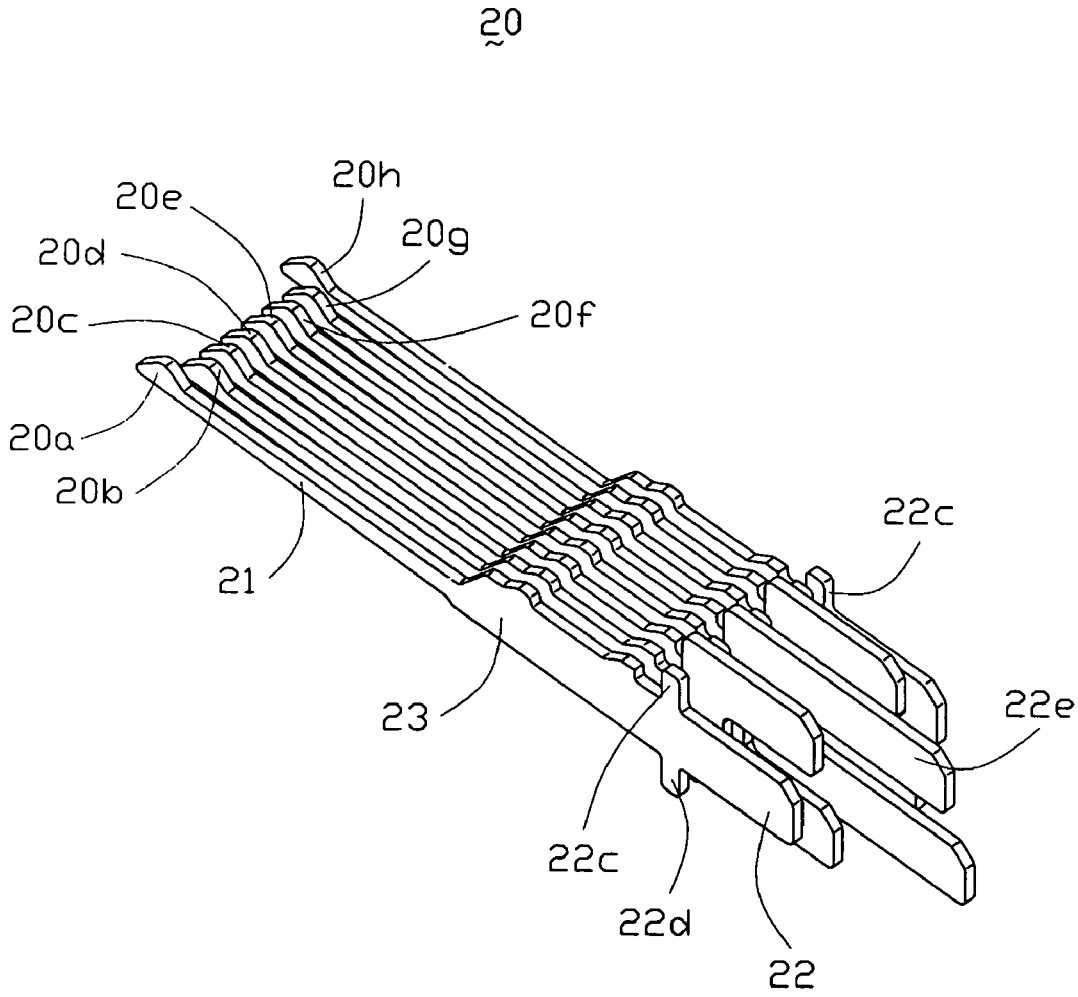
FIG. 4 is a perspective view of a contact set of the cable connector shown in FIG. 1.
Figure 11:
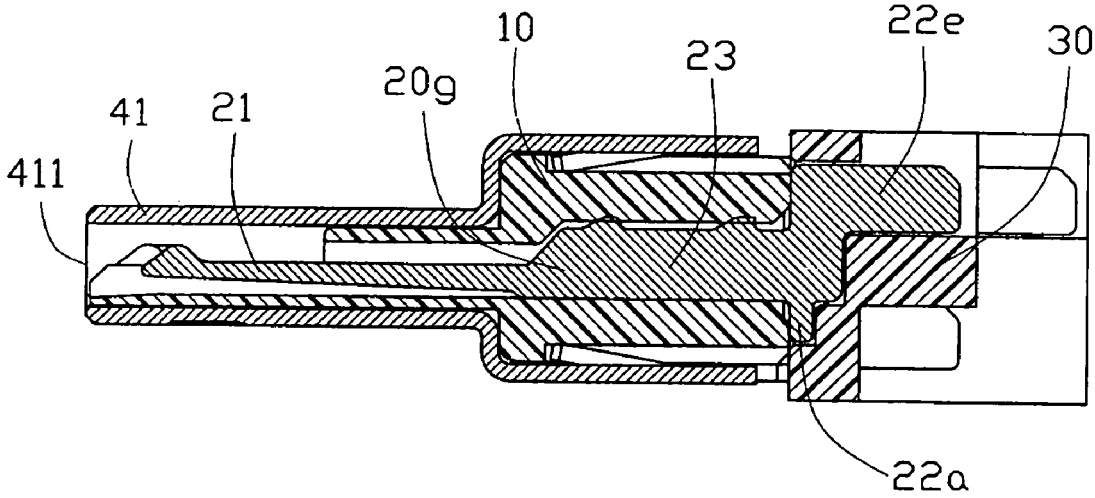
FIG. 11 is a cross-sectional view of the cable connector of FIG. 10 taken along line 11—11.
Figure 12:
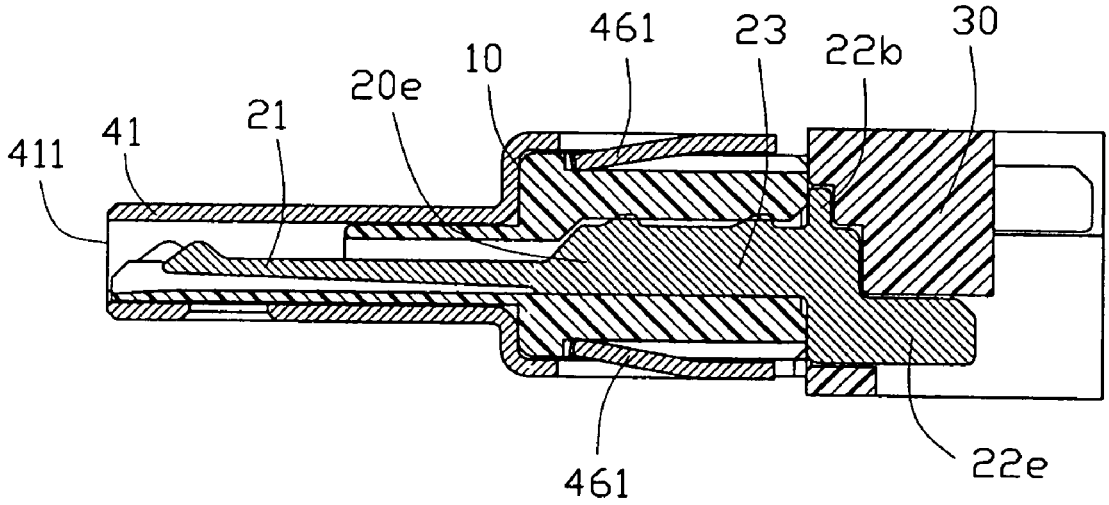
FIG. 12 is a cross-sectional view of the cable connector of FIG. 10 taken along line 12—12.
Figure 13:
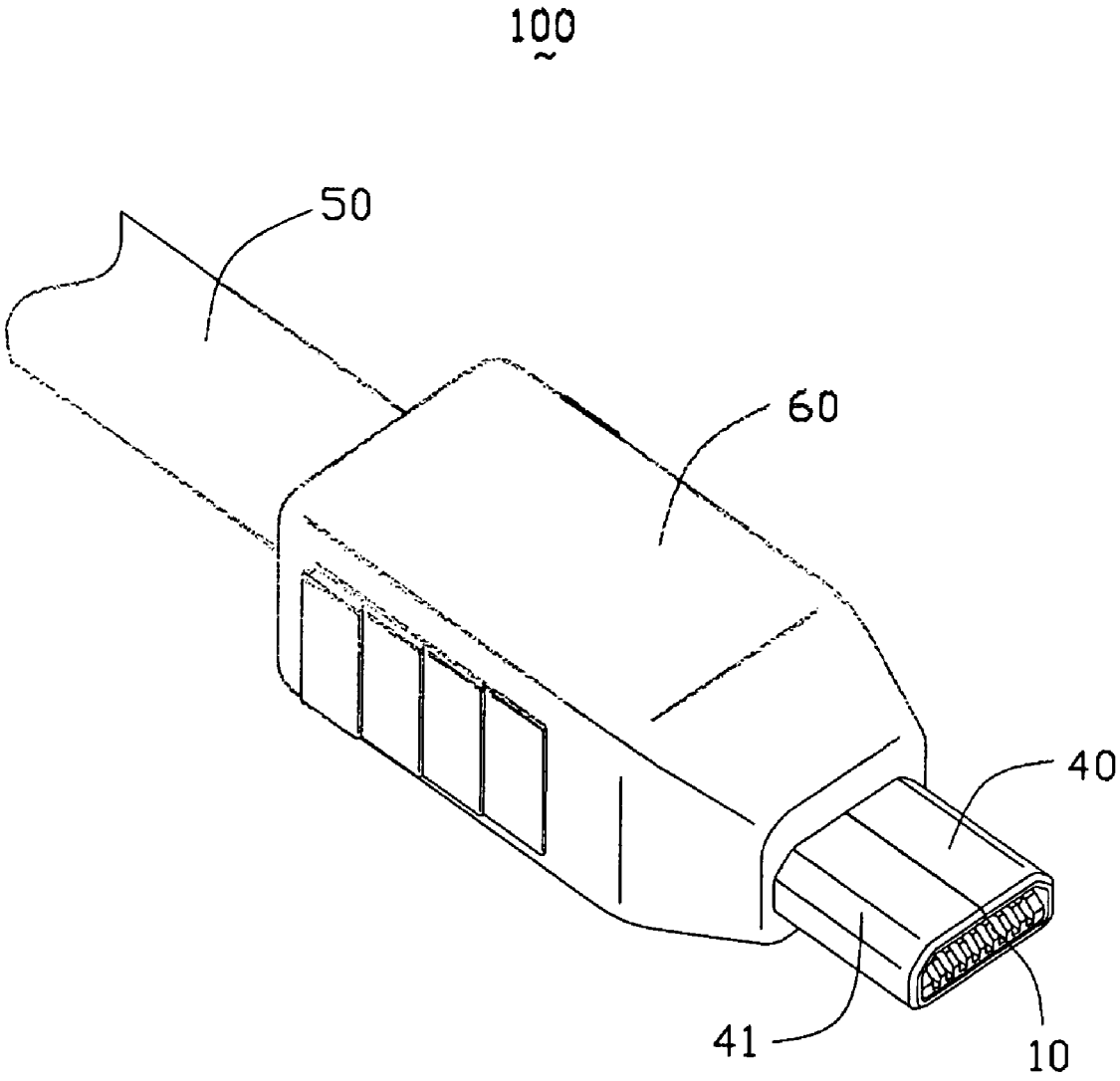
FIG. 13 is a perspective, assembled view of the cable connector of FIG. 2.
Figure 14:
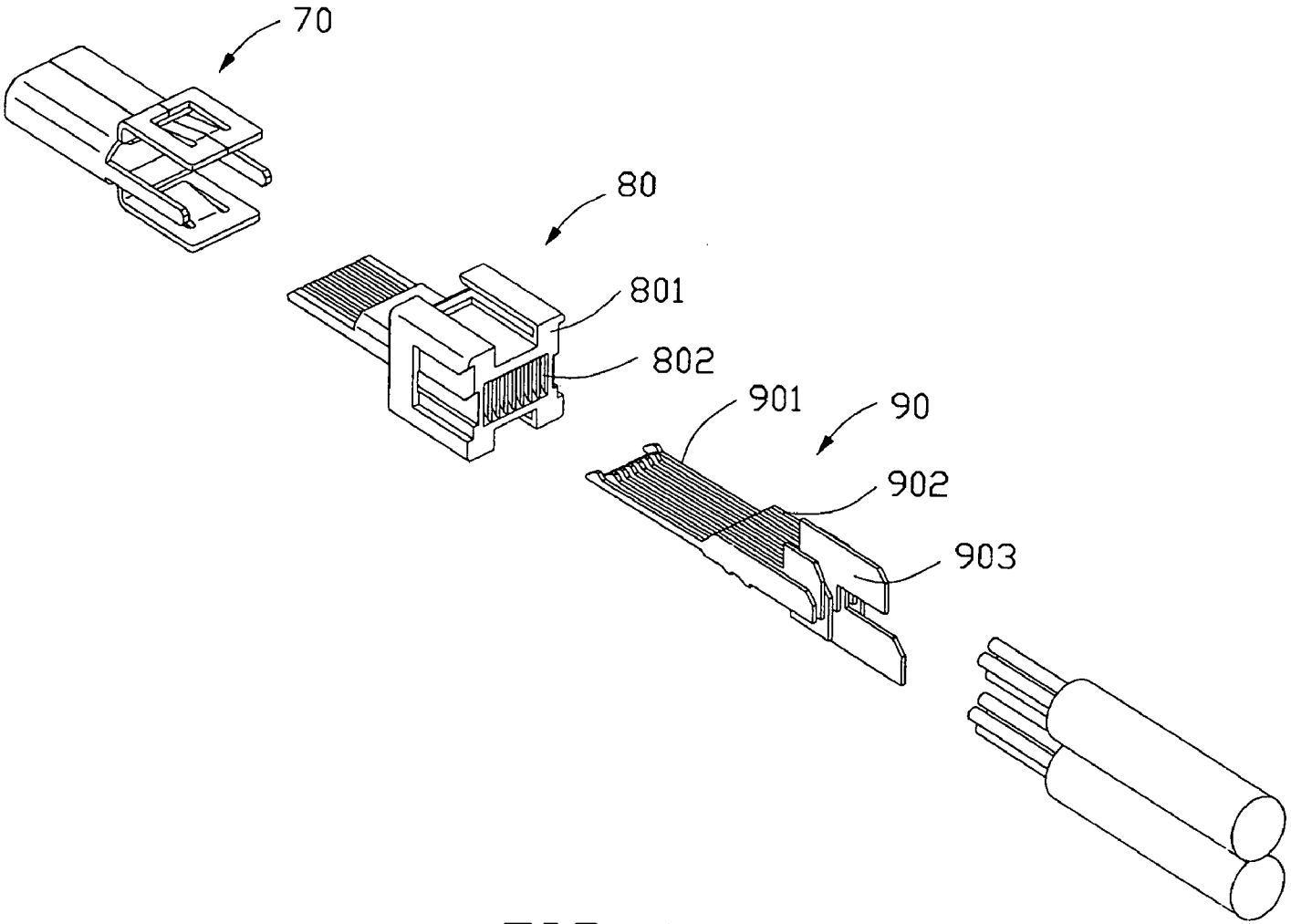
FIG. 14 (PRIOR ART)
FIG. 14 is an exploded, perspective view of a conventional cable connector, with a cover not shown.
Figure 15:
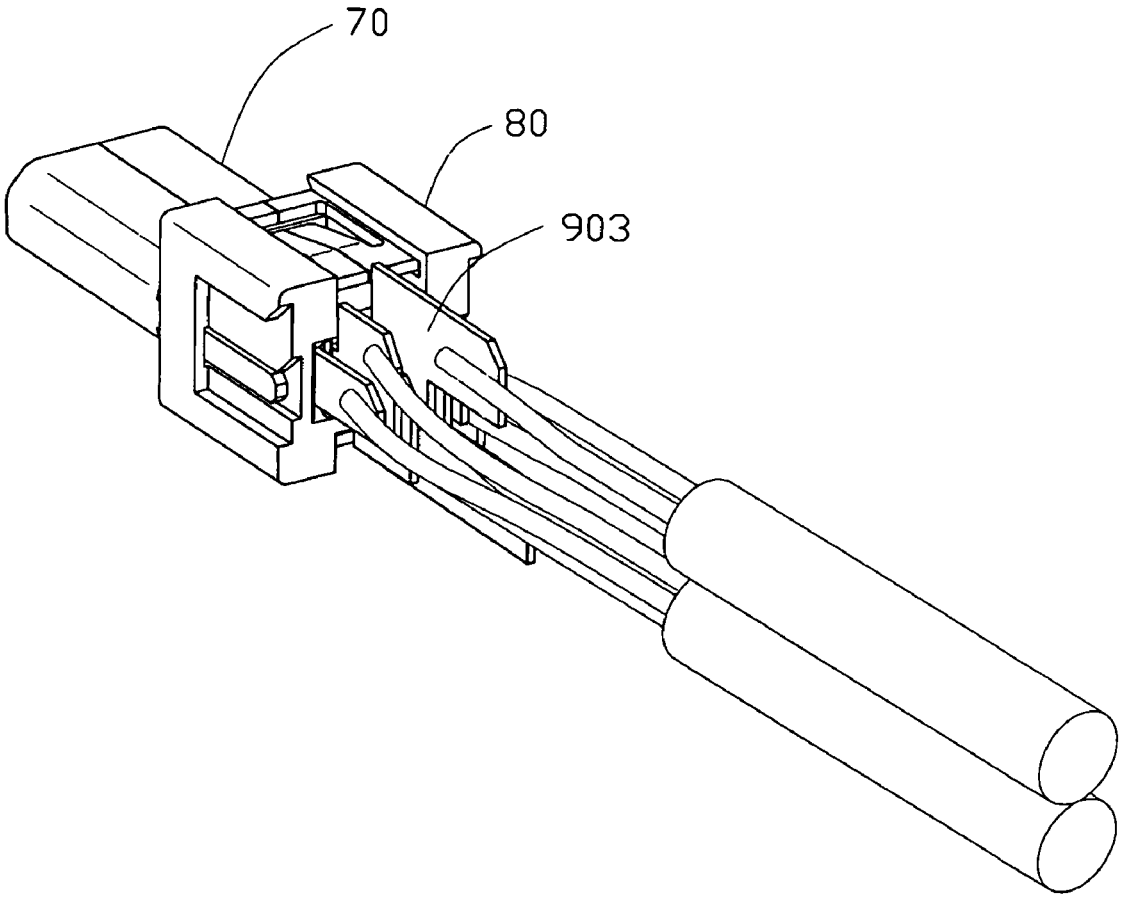
FIG. 15 (PRIOR ART)
FIG. 15 is an assembled view of FIG. 14.

With reference to FIG. 4, the contact set 20 comprises eight contacts arranged side-by-side in the lateral direction and respectively labeled as 20*a* to 20*h*. Each contact is arranged in a plane defined by the lengthwise and vertical directions, and comprises a contacting portion 21 for electrically connecting with a complementary connector (not shown), an intermediate portion 23 extending rearwardly from the contacting portion 21, and a tail portion 22 extending rearwardly from the intermediate portion 23. The contacts 20*a* and 20*h* are located at opposite sides of the contact set 20 and symmetrical with each other with respect to a supposed longitudinal axis between the contacts 20*d* and 20*e*. Similarly, the contacts 20*b* and 20*g* are symmetrical with each other with respect to the supposed longitudinal axis, and the contacts 20*c* and 20*f* are symmetrical with each other with respect to the supposed longitudinal axis. The contacts 20*a* and 20*h* are power contacts, and the other contacts of the contact set 20 are signal contacts. The power contacts 20*a*, 20*h* both have a longer contacting portion than the signal contacts. The eight contacts 20*a*–20*h* have the same intermediate portions 23. The tail portions of the contact set 20 are interlaced with higher and lower arrangement. The tail portion 22 of the contacts 20*a* and 20*h* are rearwardly extending from corresponding intermediate portion 23 directly. The tail portions 22 of the signal contacts 20*b*–20*g* have substantially the same configuration. The tail portions 22 of the contacts 20*c*, 20*e* and 20*g*, and those of the contacts 20*b*, 20*d* and 20*f* are angled in an opposite direction with respect to the tail portions 22 of the contacts 20*a* and 20*h*. The tail portion 22 of the contacts 20*c*, 20*e*, 20*g* are arranged in a higher elevation than the tail portion 22 of the contact 20*a*, while the tail portion 22 of the contacts 20*b*, 20*d*, 20*f* are arranged in a lower elevation than the tail portion 22 of the contact 20*a*. The "higher" contacts 20*c*, 20*e*, 20*g* each have a lower end portion 20*a* (as best shown in FIG. 11), and the "lower" contacts 20*b*, 20*d*, 20*f* each has a higher end portion 22*b* (as best shown in FIG. 12). The power contacts 20*a*, 20*h* each has top and bottom end portions 22*c*, 22*d*. Each tail portion 22 has a flat portion 22*e*. The tail portions 22 of the contacts 20*b*, 20*c*, 20*f* and 20*g* have the same length. The tail portion 22 of the contact 20*e* is longer than that of the contact 20*b* and shorter than that of the contact 20*d*. As the tail portions 22 of the contact set 20 are positioned at different elevation, the distance between every adjacent two contacts remains small, while the distance between adjacent tail portions 22 is significantly increased, which results in conveniently soldering the cable 50 thereunto.

Figure 5:
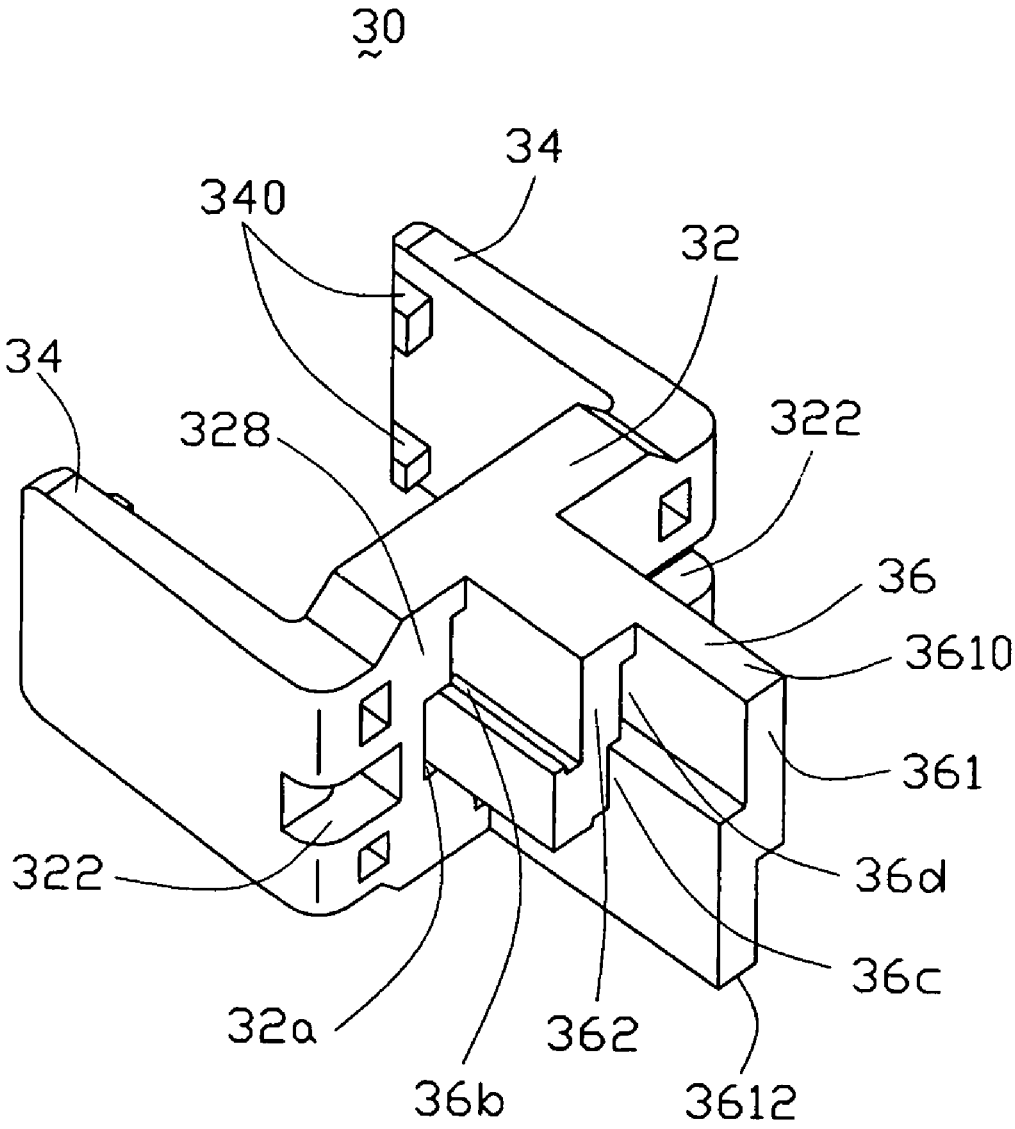
FIG. 5 is a perspective view of a contact holder of the cable connector shown in FIG. 1.
Figure 6:
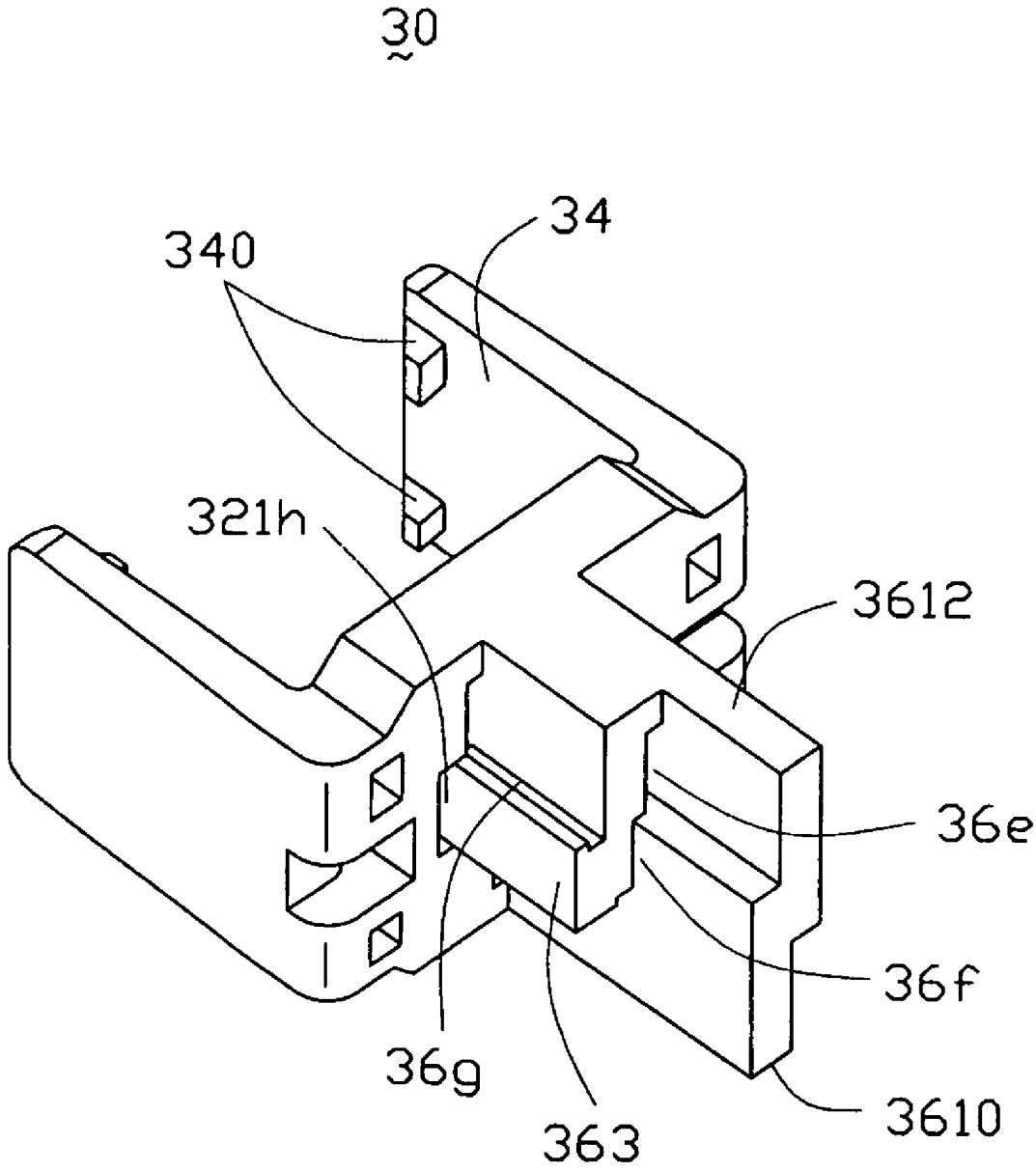
FIG. 6 is a view similar to FIG. 1, but from a different aspect.
Figure 7:
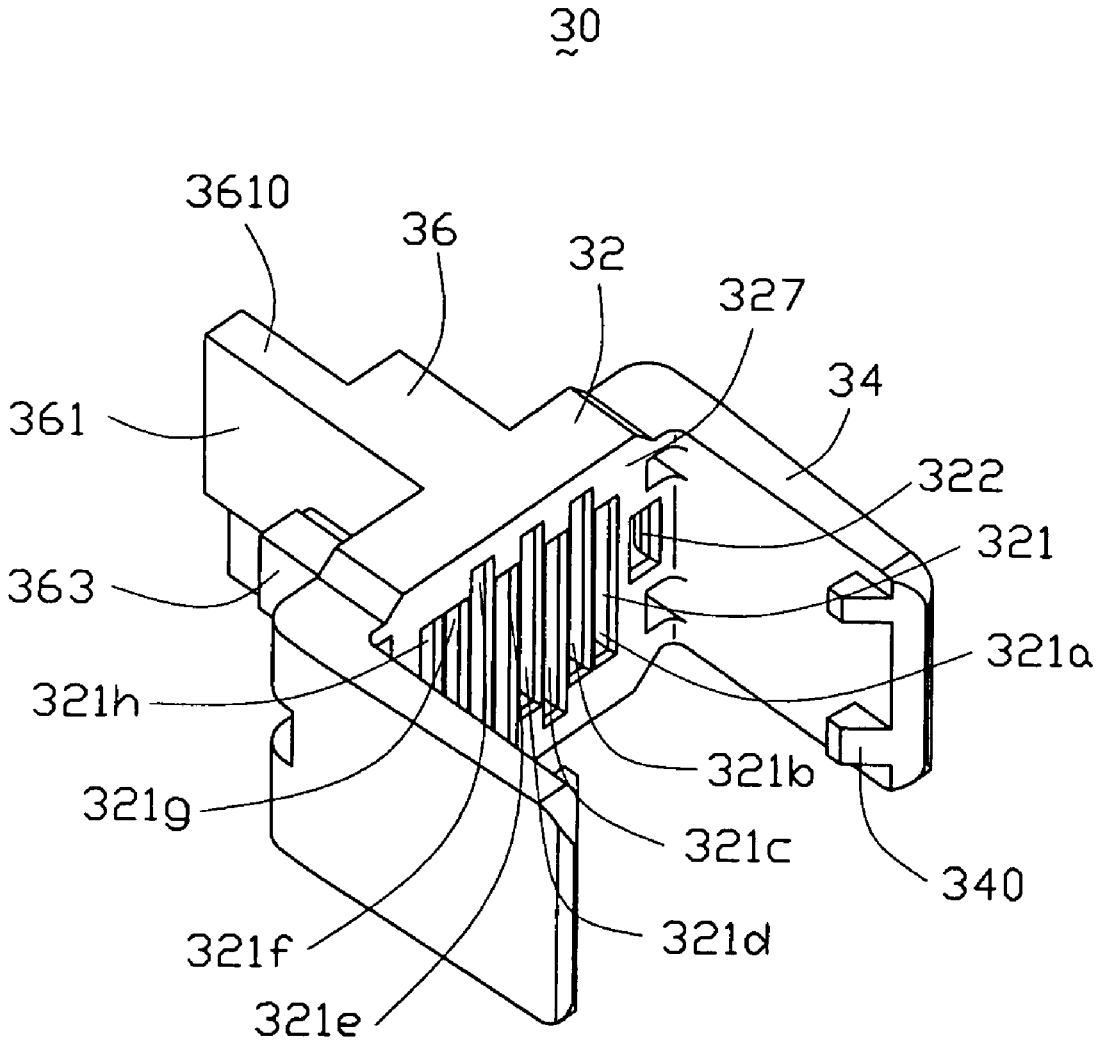
FIG. 7 is a perspective view of the contact holder shown in FIG. 2.
Figure 8:
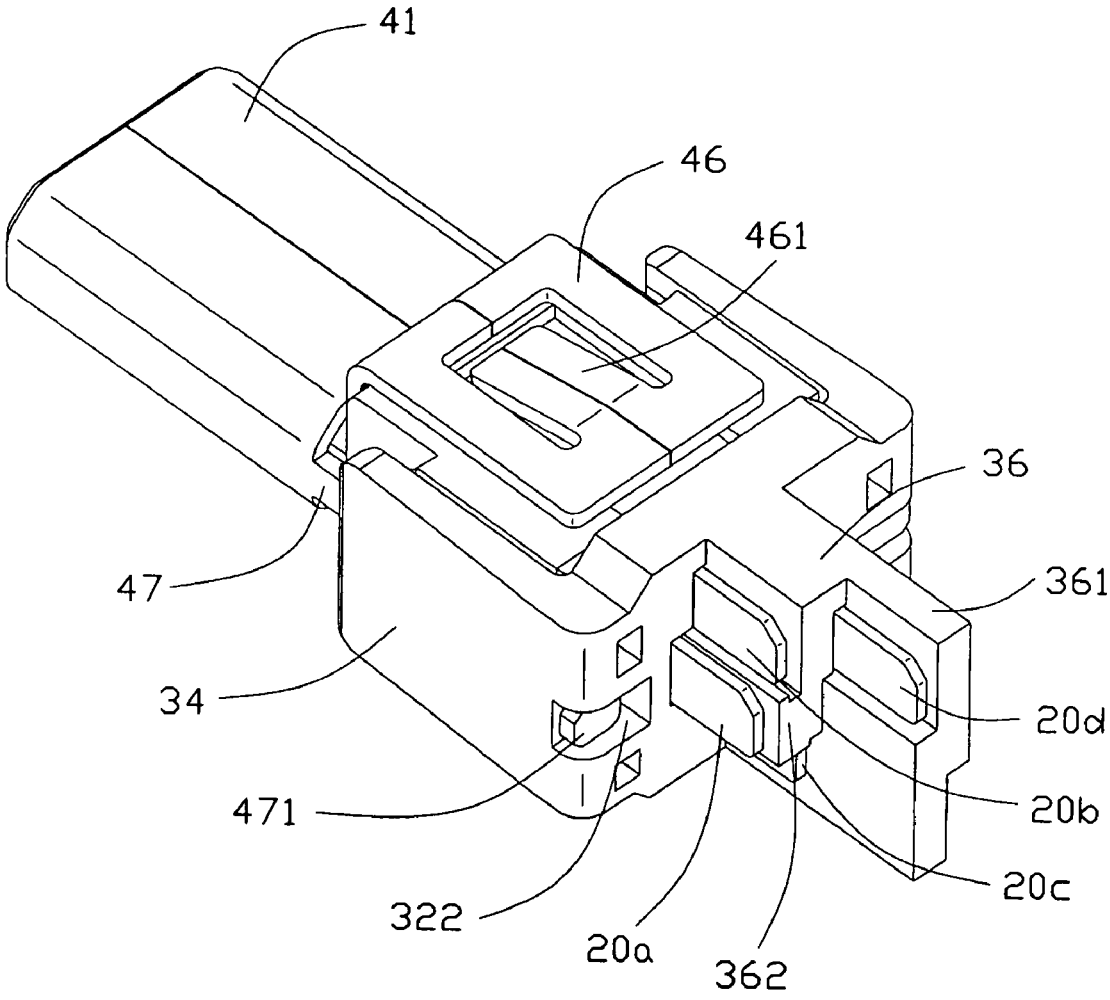
FIG. 8 is a partially assembled view of FIG. 1, with an overmold and a cable removed.
Figure 9:
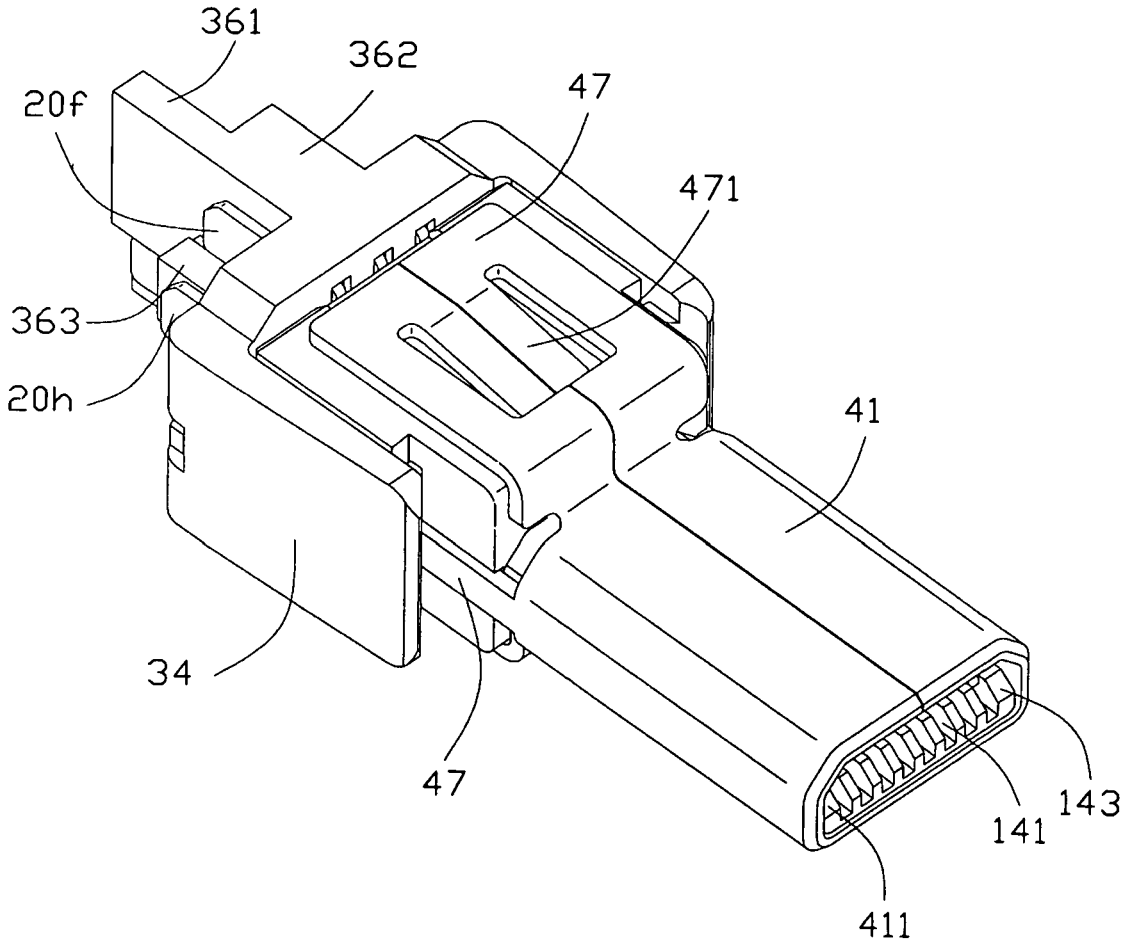
FIG. 9 is a view similar to FIG. 8, but from a different aspect.
Figure 10:
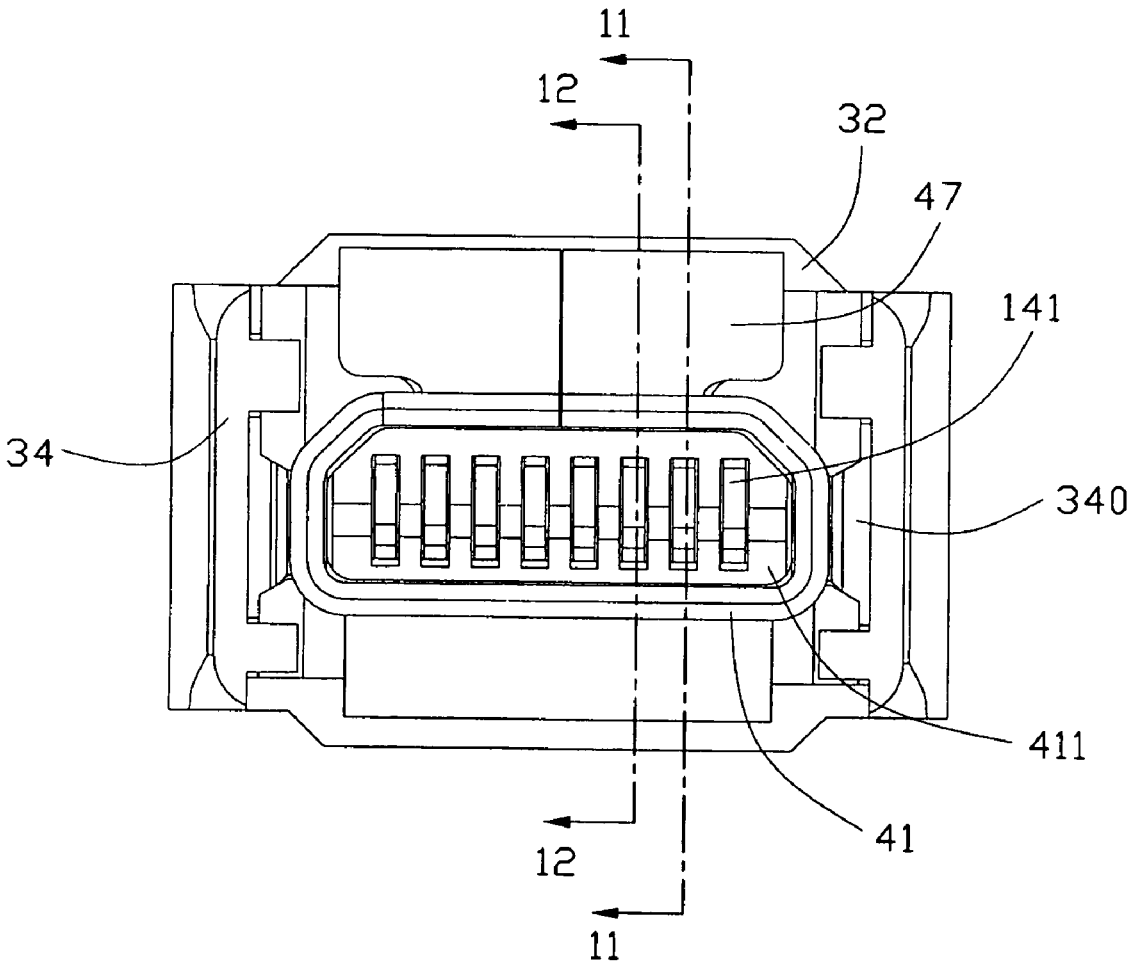
FIG. 10 is a front view of the partially assembled cable connector of FIG. 9.

With reference to FIGS. 5–7, the contact holder 30 comprises a base 32, a pair of arms 34 extending forwardly from lateral ends of the base 32 and each having a pair of latch portions 340 spaced arranged at a front end thereof, and a retention portion 36 extending rearwardly from the base 32. The base 32 defines a plurality of second passageways 321 and a pair of holes 322 at opposite lateral ends of the second passageways 321. The second passageways 321 comprise eight ones 321*a*–321*h* with three different dimensions in the vertical direction for engagingly receiving the tail portions 22 of the contacts 20*a*–20*h*, respectively. The retention portion 36 comprises a stepped middle retention post 361 and a pair of first and second side retention posts 362, 363. The middle retention post 361 comprises an upper surface 3610 and a lower surface 3612. The first and second side retention posts 362, 363 have the same shape as each other but angled in an opposite direction with respect to a longitudinal central axis of the middle retention post 361. A top surface of the first side retention post 362 is coplanar with the upper surface 3610 of the middle retention post 361. A bottom surface of the second side retention post 363 is coplanar with the lower surface 3612 of the middle retention post 361. Particularly referring to FIG. 5, the first side retention post 362 defines a first groove 36*b* communicating with the second passageway 321*b*. The first side retention post 362 and the middle retention post 321 corporately define a second and third grooves 36*c*, 36*d* respectively communicating with the second passageways 321*c*, 321*d*. Particularly referring to FIG. 6, the second side retention post 363 defines a fourth groove 36*e* communicating with the second passageway 321*e*. The second side retention post 363 and the middle retention post 321 corporately define a fifth and sixth grooves 36*f*, 36*g* respectively communicating with the second passageways 321*f*, 321*g*. The grooves 36*b*–36*g* defined in the contact holder 30 are divided into two groups, wherein the first groove 36*b*, the third groove 36*d*, the fifth groove 36*f* are aligned with one another in a row in the lateral direction, and the second groove 36*c*, the fourth groove 36*e*, the sixth groove 36*g* are aligned with one another in another row in the lateral direction. The pair of holes 322 each have a smaller caliber in an inner face 327 (FIG. 7) of the base 32 and a larger caliber in an outer face 328 (FIG. 5) of the base 32. The middle retention post 361 and the pair of side retention posts 362, 363 are disposed to separate the eight contacts 20*a*–20*h* so as to prevent the contacts 20*a*–20*h* from short.

Referring back to FIGS. 1–2, the metal shell 40 comprises a substantially cylindrical main body 41 defining a mating port 411, a pair of fixing portions 46 extending rearwardly from upper and lower rear edges of the main body 41, and a pair of fixing arms 47 extending rearwardly from rear side edges of the main body 41 and each having a bent end 471. Each fixing portion 46 defines a resilient tab 461 thereon.

The cable 50 comprises eight wires 52. Each wire 52 comprises an insulative layer 53 and a conductor 54 surrounded by the insulative layer 53.

In assembly, referring to FIGS. 1–12, the contact set 20 is inserted into the first passageways 121 of the insulative housing 10 in a back-to-front direction. The contacting portions 21 of the contact set 20 are received in the contact channels 141 of the tongue 14, and exposed on the mating portion 143. The intermediate portions 23 of the contact set 20 are located in the retaining portion 142 of the tongue 14. The tail portions 22 of the contact set 20 project beyond the rear face of the insulative housing 10.

Referring to FIGS. 8–12, the contact holder 30 is inserted into the assembled housing 10 and the contact set 20 from rear to front. The contact holder 30 and the housing 10 are engaged with each other with latch portions 340 of the arms 34 of the contact holder 30 extending into the recesses 129 of the base portion 12 of the housing 10 and latching with the side walls 124, 125 of the housing 10. The contacts 20*a*–20*h* are inserted into the second passageways 321*a*–321*h*, respectively, with the lower end portions 22*a*, the higher end portions 22*b*, the top end portions 22*c* and the bottom end portions 22*d* of the tail portions 22 of the contacts 20*a*–20*h* received in corresponding second passageways 321 and the flat portions 22*e* partially extending beyond the outer face 328 of the base 32 of the contact holder 30. The tail portions 22 of the contacts 20*b*–20*g* each are extended into a corresponding groove 36*b*–36*g* defined in the retention portion 36 of the contact holder 30.

In conjunction with FIG. 1 and FIG. 2, the conductors 54 of the cable 50 are respectively soldered to the tail portions 22 of the contact set 20. The metal shell 40 is assembled on the insulative housing 10 in a front-to-back direction with the fixing portions 46 thereof positioned above the depressions 126, 127 of the housing 10, the resilient tabs 461 thereof resiliently pressing against bottom and top surfaces of the depressions 126, 127, and the fixing arms 47 extending through the slots 128 of the housing 10. The bent ends 471 of the metal shell 40 penetrate the holes 322 of the contact holder 30 and fasten to the arms 34.

With reference to FIGS. 1–13, the overmold 60 is overmolded on the metal shell 40, the contact holder 30, and a conjunction between the tail portions 22 of the contact set 20 and the conductors 54 of the cable 50, with only the main body 41 of the metal shell 40 and the cable 50 exposed. Therefore, the cable connector 100 is assembled.

The contact holder 30 can fix the contact set 20 in the housing 10, thus, effectively preventing the contact set 20 from rearwardly moving when soldering the conductor 54 of the cable 5 thereon.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

an insulative housing;

a plurality of contacts, each contact comprising a contacting portion received in the insulative housing and a tail portion rearwardly extending beyond the housing;

a contact holder mounted to the insulative housing and latchably engaged with the housing, the contact holder defining a plurality of passageways, each tail portion of the contacts passing through a corresponding passageway; and a cable having a plurality of conductors soldered to corresponding tail portions of the contacts; wherein the insulative housing comprises a base portion and a tongue extending forwardly from the base portion, the contact holder latches with the base portion; wherein the base portion of the housing comprises a top wall and a bottom wall spaced arranged in a vertical direction, and a pair of side walls spaced arranged in a lateral direction, the contact holder comprises a base and a pair of arms extending forwardly form lateral sides of the base, and wherein each arm has a latch portion to latch with the side walls of the insulative housing; wherein the contact holder comprises a retention portion extending outwardly from substantially a middle of the base and defining a plurality of grooves, and communicating with the passageways, and wherein the tail portions of the contacts are respectively received in the grooves; wherein the retention portion comprises a first retention post and a second retention post on each side thereof, the first and the second retention posts separating the tail portions of each contact for preventing the contacts from short, further comprising a metal shell enclosing the tongue of the insulative housing and latching with the contact holder, further comprising an overmold enclosing the insulative housing, the shell and the contact holder.

2. The cable connector as claimed in claim 1, wherein the metal shell comprises a main body enclosing the tongue and a fixing portion extending rearwardly from the main body and covering the base portion of the insulative housing.

3. The cable connector as claimed in claim 2, wherein the fixing portion comprises a resilient tab pressing against top and bottom wall of the insulative housing.

4. The cable connector as claimed in claim 1, wherein the housing defines a pair of slots in the side walls in a lengthwise direction, and wherein the metal shell comprises a pair of fixing arms extending rearwardly from lateral ends of the main body and received in the slots.

5. The connector as claimed in claim 4, wherein each fixing arm has a bent end, the contact holder define a pair of holes through the base thereof, and wherein the bent ends of the fixing arms passing through the holes and fasten with the arms of the contact holder.

6. The cable connector as claimed in claim 1, wherein at least two tail portions of the contacts are arranged in different elevations in the vertical direction.

7. The cable connector as claimed in claim 6, wherein at least two tail portions of the contacts have different lengths in a lengthwise direction.

8. The cable connector as claimed in claim 1, wherein every neighboring two tail portions of the contacts are arranged in different elevations.

9. The cable connector as claimed in claim 1, wherein the two contacts located at opposite lateral sides of the contacts are power contacts, and the other contacts are signal contacts, and wherein the power contacts each has a longer contacting portion than those of the signal contacts.

10. A cable connector assembly comprising:

an insulative housing defining a plurality of juxtaposed first passageways in a front-to-back direction;

a contact holder attached to a rear side of the housing and defining a plurality of juxtaposed second passageways in alignment with the corresponding first passageways, respectively, along said front-to-back direction;

a retention portion formed on a rear side of the contact holder and defining a plurality of juxtaposed retention slots, corresponding to the respective second passageways, located at different positions in the front-to-back direction or at different levels in a vertical direction perpendicular to said front-to-back direction;

a plurality of contacts each including a mating section disposed in the corresponding first passageway, and a tail section supportably received in the corresponding second passageway and the corresponding retention slot to join a corresponding wire; and said retention portion including a first stepped retention post with a first Z-like cross-section thereof, said first stepped retention post extending along the front-to-back direction with a first distance, and a second stepped retention post located beside said first stepped retention post with a second Z-like cross-section thereof, said second stepped retention post extending along the front-to-back direction with a second distance; wherein said first distance is larger than said second distance; wherein one of the contact holder and the housing comprises arms having latch portions thereon, the other of the contact holder and the housing comprises recesses, and the contact holder and the housing are engaged with each other with the latch portions extending into the recesses; wherein said first stepped retention post is located at a middle area of the retention portion, and said second stepped retention post is located at a side area of the retention portion.

11. The cable connector assembly as claimed in claim 10, wherein the mating sections are located at the same level while the tail sections are located at different levels.

12. The cable connector assembly as claimed in claim 10, wherein the first Z-like cross-section is larger than the second Z-like cross-section.

13. A cable connector assembly comprising:

an insulative housing defining a plurality of juxtaposed first passageways in a front-to-back direction;

a contact holder attached to a rear side of the housing and including a retention portion defining a plurality of juxtaposed retention slots located at different positions in the front-to-back direction or at different levels in a vertical direction perpendicular to said front-to-back direction;

a plurality of contacts each including a mating section disposed in the corresponding first passageway, and a tail section supportably received in the corresponding retention slot to join a corresponding wire;

the tail section of the contact is offset from that of the neighboring contact in either front-to-back direction or the vertical direction; and said retention portion including a first stepped retention post with a first Z-like cross-section thereof, said first stepped retention post extending along the front-to-back direction with a first distance, and a second stepped retention post located beside said first stepped retention post with a second Z-like cross-section thereof, said second stepped retention post extending along the front-to-back direction with a second distance; wherein said the first Z-like cross-section is larger than the second Z-like cross-section; wherein one of the contact holder and the housing comprises arms having latch portions thereon, the other of the contact holder and the housing comprises recesses, and the contact holder and the housing are engaged with each other with the latch portions extending into the recesses; wherein said first stepped retention post is located at a middle area of the retention portion, and said second stepped retention post is located at a side area of the retention portion.

14. The cable connector assembly as claimed in claim 13, wherein said first distance is larger than said second distance.

* * * * *